US008430172B1

(12) United States Patent
Smith et al.

(10) Patent No.: US 8,430,172 B1
(45) Date of Patent: Apr. 30, 2013

(54) BUOYANT BALL ASSISTED HYDROCARBON LIFT SYSTEM AND METHOD

(75) Inventors: Rodney Dee Smith, North Ogden, UT (US); Travis Jason Smith, Houston, TX (US)

(73) Assignee: Smithsonian Energy, Inc., Sandy, UT (US)

( * ) Notice: Subject to any disclaimer, the term of this patent is extended or adjusted under 35 U.S.C. 154(b) by 0 days.

(21) Appl. No.: 13/568,471

(22) Filed: Aug. 7, 2012

Related U.S. Application Data

(60) Provisional application No. 61/659,394, filed on Jun. 13, 2012.

(51) Int. Cl.
*E21B 43/16* (2006.01)

(52) U.S. Cl.
USPC ..... 166/372; 166/305.1

(58) Field of Classification Search ..... 166/284, 166/305.1, 372
See application file for complete search history.

(56) References Cited

U.S. PATENT DOCUMENTS

| | | | | |
|---|---|---|---|---|
| 1,740,100 | A | 7/1927 | Lake | |
| 3,112,800 | A * | 12/1963 | Bobo | 175/67 |
| 5,526,879 | A | 6/1996 | Champ et al. | |
| 6,530,437 | B2 * | 3/2003 | Maurer et al. | 175/5 |
| 7,040,401 | B1 * | 5/2006 | McCannon | 166/250.15 |
| 7,134,283 | B2 | 11/2006 | Villalobos | |
| 7,383,896 | B2 * | 6/2008 | Tibbitts | 175/66 |
| 7,987,928 | B2 * | 8/2011 | Vuyk et al. | 175/67 |

FOREIGN PATENT DOCUMENTS

| | | |
|---|---|---|
| CA | 2212447 | 5/2008 |

* cited by examiner

*Primary Examiner* — Shane Bomar
*Assistant Examiner* — Catherine Loikith
(74) *Attorney, Agent, or Firm* — Lyman Moulton, Esq.

(57) ABSTRACT

As disclosed, a buoyant ball assisted hydrostatic lift system and method for lifting fluid(s) from an enclosed subterranean reservoir to the earth's surface, comprises a pipe string configured at a steady state gas pressure with any quiescent gas escape offset by an equal gas input. The system also includes a plurality of buoyant balls in the pipe string; the balls configured to at least one of displace a fluid mass and have a surface friction moving in fluid(s) therein. The system additionally includes a column of the buoyant balls in the pipe string, an aggregate weight of the balls configured to entrain the balls into a fluid in an annulus formed with an outer bore pipe. The system further includes a hydrostatic pressure differential in the annulus with respect to the reservoir via the buoyant balls, the pressure configured to lift fluid(s) in the annulus to the surface.

20 Claims, 6 Drawing Sheets

BUOYANT BALL ASSISTED HYDROCARBON LIFT SYSTEM AND METHOD

CROSS-REFERENCE TO RELATED APPLICATIONS

This application claims the benefit of the priority date of earlier filed U.S. Provisional Patent Application Ser. No. 61/659,394, filed Jun. 13, 2012 for Rod D. Smith, incorporated herein by reference in its entirety.

BACKGROUND AND FIELD OF INVENTION

Subterranean wells may be drilled primarily to extract fluids such as water, hydrocarbon liquids and hydrocarbon gases. These fluids exist within the earth to depths in excess of 5000 meters below the earth's surface. Subterranean traps, called reservoirs, accumulate the fluids in sufficient quantities to make their recovery economically viable. Whether or not a fluid of interest can reach the earth's surface without aid may be a function of the potential energy of the fluid in the reservoir, reservoir driver mechanisms, reservoir rock characteristics, near wellbore rock characteristics, physical properties of the desired fluid and associated fluids, depth of the reservoir, wellbore configuration, operating conditions of the surface facilities receiving fluids and the stage of the reservoir's depletion.

Many wells in the early stages of production are capable of producing fluids with little more than a pipe to connect the reservoir with surface facilities, as energy from the reservoir and changing fluid characteristics can lift desired fluids to the surface. However, to improve the economics of a well, it may be necessary to increase the production rate and maximize the recovery of the desired fluid(s) from the well. Transportation of fluids from the reservoir to the surface, that is well bore dynamics, is one of the variables of the well that can be controlled and has a major impact on the economics of a well.

One can improve well bore dynamics by two methods: 1) designing a wellbore configuration that optimizes and improves the flow characteristics of the fluid in the well bore conduit, and/or 2) aiding in lifting the fluid to surface with artificial lift. Artificial lift can significantly improve production early in life of many wells and may be the only option for wells operating in the later stages of depletion. There are numerous systems of artificial lift available and operating throughout the world. The more common systems are reciprocating rod string and plunger pumps, rotating rod strings and progressive cavity pumps, electric submersible multistage centrifugal pump, jet pumps, hydraulic pumps and gas lift systems. To fit in the category of artificial lift, additional energy not from the producing formation or fluids input into the well bore is added to help lift fluids in the liquid paths to the earth's surface. With the depletion of the world's fluid reserves, there is a long felt need to develop an artificial lift system and method that is both economical and practical.

SUMMARY OF THE INVENTION

A buoyant ball assisted hydrostatic lift system and method lifts a fluid from an enclosed subterranean reservoir to the earth's surface. The disclosed system includes a pipe string configured at a steady state gas pressure with any quiescent gas escape offset by an equal gas input. The system also includes a plurality of buoyant balls in the pipe string; the balls configured to at least one of displace a fluid mass and have a surface friction moving in a fluid therein. The system additionally includes a column of the buoyant balls in the pipe string, an aggregate weight of the balls in the column configured to entrain the balls into a fluid in an annulus formed with an outer bore pipe. The system further includes a hydrostatic pressure differential in the annulus with respect to the reservoir via the buoyant balls, the pressure configured to lift the entraining fluid and the entrained balls in the annulus to the surface.

The disclosed method includes providing a pipe string configured at a steady state gas pressure with a quiescent gas escape offset by an equal gas input. The method also includes providing a plurality of buoyant balls in the pipe string; the balls configured to at least one of displace a fluid mass and have a surface friction moving in a fluid therein. The method additionally includes providing a column of the buoyant balls in the pipe string, an aggregate weight of the balls in the column configured to entrain the balls into a fluid in an annulus formed with an outer bore pipe. The method further includes creating a hydrostatic pressure differential in the annulus with respect to the reservoir via the buoyant balls, the pressure configured to lift a fluid in the annulus to the surface. The disclosed method yet includes recovering the buoyant balls from the fluid lifted to the surface in a recovery reservoir at atmospheric pressure.

Other aspects and advantages of embodiments of the disclosure will become apparent from the following detailed description, taken in conjunction with the accompanying drawings, illustrated by way of example of the principles of the disclosure.

Figure 1:
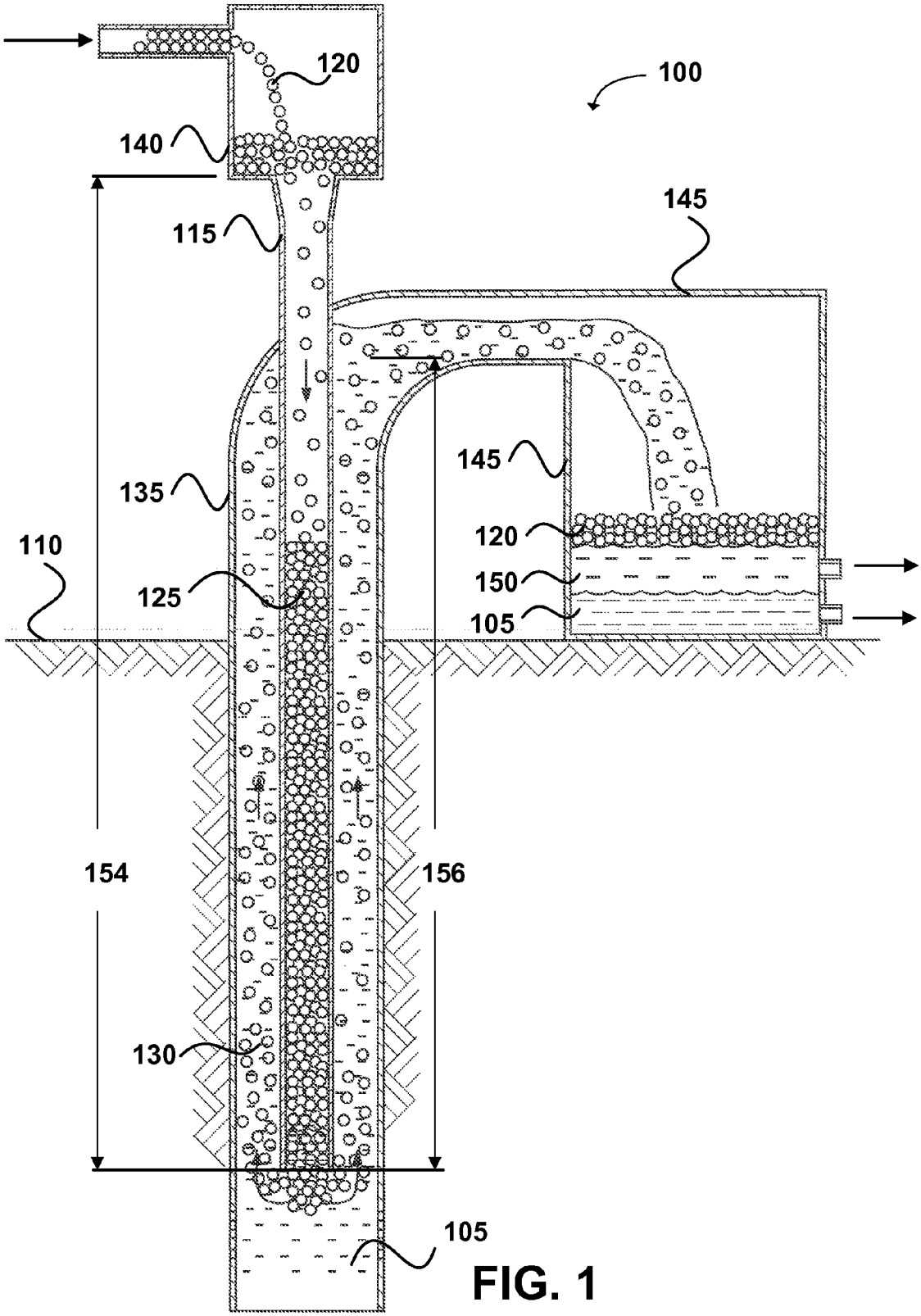
FIG. 1 is a cross sectional view of a buoyant ball assisted hydrostatic lift system in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Present best known methods may include artificial lift via a high pressure source at the surface of a well to inject gas down an annulus and into a tubing bore. The compressed gas may be injected into the product stream through valves and may create an aeration or bubbling effect in the liquid column. The gas bubbles may expand as they rise to the surface, displacing liquid around them. This may decrease the density and weight of the fluid and create a differential pressure between the reservoir and the well bore and allow the well to produce at its optimum rate. However, the recovery and necessary recompression of gases used for lifting is expensive and cumbersome. There is a long felt need in the market of hydrostatic artificial lift systems for a system and method that is both economical and practical without the expensive use of gases.

The term 'pipe string' as used throughout the present disclosure defines a column or string of pipe that transmits the lifting and/or drilling mechanisms. The term 'annulus' used throughout the disclosure defines a ring of space between a well bore inner wall and a pipe string outer wall where the pipe string is positioned within the well bore. The term 'fluid' as used throughout the present disclosure defines both a gas and a liquid. The term 'ball' as used throughout the present disclosure may refer to circular, semi-circular and other geometrical bead-like or bubble-like devices having rigid or semi-rigid walls and various sizes, shapes, porosities, specific gravities and various configurations including dimples, cavities (external and internal), recesses and the like. The term 'quiescent' used throughout the disclosure follows the common definition of being motionless and at rest and therefore refers to a substantially motionless gas at rest. Similarly, the term 'steady state' follows the common definition of a stable condition that does not change over time and therefore refers to a stable gas pressure that does not change over time because any gas escape is offset by an equal gas input.

The purpose of the disclosed apparatus, system and method is to improve the volume of discharged fluids flowing from a well bore. In the alternative, if the well is within equilibrium and can no longer naturally flow, the disclosed process may initiate natural flow again. This is accomplished by changing the hydrostatic pressure within a fluid column through a mechanism of displacing fluid mass with buoyant balls sharing the space within the casing in a flowing well. This reduction in hydrostatic pressure may increase the net amount of fluids flowing in a given increment of time.

One embodiment of the disclosure takes advantage of the down pipe that is normally used to contain the flow of fluids to the surface and uses it as a conduit to transfer the buoyant balls down the bore hole to a desired depth. To facilitate the process of getting the balls to the bottom of the pipe, gas pressure is used to push down the water table in this center pipe (aka pipe string) to varying depths forming a gas column. As an example, at approximately a 5,000 foot level, if the water table ascended from the reservoir to the top (or the surface) of that pipe, and if there was no more natural reservoir pressure to push the liquid beyond the surface, it may take approximately (depending on the specific gravity of the liquid) 2200 psi of gas pressure to push the water table that was at the surface all the way down the pipe to the 5,000 foot predetermined level.

In an embodiment of the disclosure, the gas does not exit the bottom of pipe string, but instead, only enough pressure is administered to take the water table down to a very short distance from the end of the pipe. This creates a hollow void of steady state gas pressure occupying the internal volume of the pipe all the way back up to the surface. In contrast, the annulus between the pipe string and the well bore could be full of liquid from the reservoir to any point, all the way up to the surface.

Embodiments of the disclosure include small buoyant balls fed into the pipe string. Under the force of gravity, the balls may fall all the way down to the water table 5,000 feet below. Since the balls are buoyant, they may float on the water table at the bottom of the pipe. As the accumulated amount of buoyant balls land on top of each other, the aggregated weight will eventually push the lower balls down into the liquid until they reach the end of the pipe and start their ascension up the annulus entrained in the fluid(s) of the reservoir.

As the volume of balls increase in the annulus, the hydrostatic pressure housed in the annulus may start decreasing. The resisting force that the column is putting on the reservoir starts to lower and the spread between the reservoir's pressure and the column resisting hydrostatic pressure gets wider. This increase in differential pressure may allow the well to start flowing again, or increase the volume of a well that is currently flowing. The annulus may thus be used to discharge the flow coming to the surface verses the concentric pipe that is conventionally used as a gas column. A disclosed mechanism gathers these buoyant balls at the surface and puts them in an apparatus that allows them to overcome the pressure required to reenter the gas column described earlier.

FIG. 1 is a cross sectional view of a buoyant ball assisted hydrostatic lift system in accordance with an embodiment of the present disclosure. The disclosed buoyant ball assisted hydrostatic lift system 100 lifts a fluid 105 from an enclosed subterranean reservoir to the earth's surface 110. The disclosed system 100 includes a pipe string 115 configured at a steady state gas pressure with any quiescent gas escape offset by an equal gas input. The system also includes a plurality of buoyant balls 120 in the pipe string 115, the balls configured to at least one of displace a fluid mass 105 and have a surface friction moving in a fluid 105 therein. The surface friction may come from a design and/or a type of covering on the buoyant ball's surface as disclosed herein. Materials and designs having larger surface friction may increase the hydrostatic pressure differential as discussed herein. Conversely, materials and designs having less surface friction may decrease the hydrostatic pressure differential. Any design increasing the surface area of a buoyant ball may increase its surface friction and therefore increase the pressure differential in the annulus or vice versa in the pipe string. The pressure differential (pressure loss) may result from a heating the fluid(s) due to the surface friction of the entrained balls causing a net loss of energy in the enclosed system including the present disclosure and the well thereof. The system 100 additionally includes a column 125 of the buoyant balls 120 in the pipe string 115, an aggregate weight of the balls 120 in the column 125 configured to entrain the balls 120 into a fluid 105 in an annulus 130 formed with an outer bore pipe 135. The system further includes a hydrostatic pressure differential lifting the entrained balls in the annulus 130 with respect to the reservoir via the buoyant balls 120, the pressure differential configured to lift the fluid 105 in the annulus 130 to the surface 110. A ball reservoir 140 and a recovery reservoir 145 are also depicted. As shown, the balls 120 fall from the reservoir 140 into the pipe string 115 under weight of gravity through the quiescent gas to an entrainment point near the end of the pipe string depicted by height 154. Water 150 may be present in the reservoir and lifted into the recovery reservoir 145 via the disclosed system and method.

A vice versa embodiment of the disclosed hydrostatic lift system wherein the steady state gas pressure and the column of buoyant balls are vice versa disposed in the annulus and an entrainment comprising the entraining fluid and the entrained buoyant balls is vice versa disposed in the pipe string, enables a hydrostatic pressure differential in the pipe string to lift the entrainment to the earth's surface. The embodiment includes an annulus pipe string configured at a steady state gas pressure with any quiescent gas escape offset by an equal gas input. The system also includes a plurality of buoyant balls in the annulus; the balls configured to at least one of displace a fluid mass and have a surface friction moving in a fluid therein. The system additionally includes a column of the buoyant balls in the annulus, an aggregate weight of the balls in the column configured to entrain the balls into a fluid in a pipe string positioned within an outer bore pipe. The system further includes a hydrostatic pressure differential in the pipe string with respect to the reservoir via the buoyant balls, the pressure configured to lift a fluid in the pipe string to the surface.

Another embodiment of the disclosed hydrostatic lift system includes buoyant balls 120 of a specific gravity less than a ratio of 1 in relation to the specific gravity of a fluid in the annulus 130. Also, the steady state gas pressure in the pipe string 115 forces a water table in the pipe string 115 submerged in the reservoir below the surface 110 and proximal to a bottom end of the pipe string submerged in the reservoir. Additionally, the column 125 of buoyant balls 120 forms under an aggregate weight of the buoyant balls 120 and extends from a bottom end of the pipe string 115 to a column height 154 greater than a height of the fluid 156 in the string pipe 115 and the annulus 130. In other words, a product of the ball density with the height of ball column 154 and gravity may be greater than a product of the fluid density with the height of fluid 156 and gravity. Ball density may be less than fluid density and gravity cancels out so the height of the column may be greater than the height of the fluid (Hc>>Hf). Embodiments include various column heights where balls of greater density and weight allow shorter columns able to entrain the balls in the fluid(s). Also, the hydrostatic pressure is a product of gravity acting on a fluid density of any fluids in the pipe string 115 and the annulus displaced by the aggregate volume of the buoyant balls 120 therein and the height of the fluids from a confluence of the balls in the fluids to an overflow of the annulus 130 at the surface 110 into a catch reservoir 145. The fluid in the disclosed system may comprise at least one of water and a petroleum fluid.

In an embodiment of the disclosed hydrostatic lift system, the surface friction of the buoyant balls 120 moving through the fluid(s) 105 creates a loss of hydrostatic pressure in the annulus 130 and creates a lift of the fluid(s) 105 at a greater hydrostatic pressure in the subterranean reservoir to the surface 110 through the annulus 130. From a conservation of energy perspective of the closed system 100, the loss of potential energy in the annulus 130 due to the friction of the balls 120 moving there through create a pressure loss which lifts the fluid(s) in the annulus.

Embodiments of the hydrostatic lift system may further include a reservoir 140 of the buoyant balls 120, the reservoir 140 disposed adjacent a top of the pipe string 115 proximal the surface 110, the reservoir 140 configured to provide buoyant balls 120 for the column 125 of the buoyant balls 120 in the pipe string 115 at the steady state gas pressure. Also, a catch reservoir 145 may be disposed adjacent a top of the annulus 130 proximal the surface 110, the reservoir 145 configured to provide a catch for the lifted fluid(s) 105 and 150 and the buoyant balls 120. Additionally, a recovery hopper and a series of valves (depicted in FIGS. 3-6) may be configured to separate the buoyant balls 120 from the fluid(s) 105 and 150 rising to the surface 110 into the catch reservoir 145 at atmospheric pressure.

Figure 2:
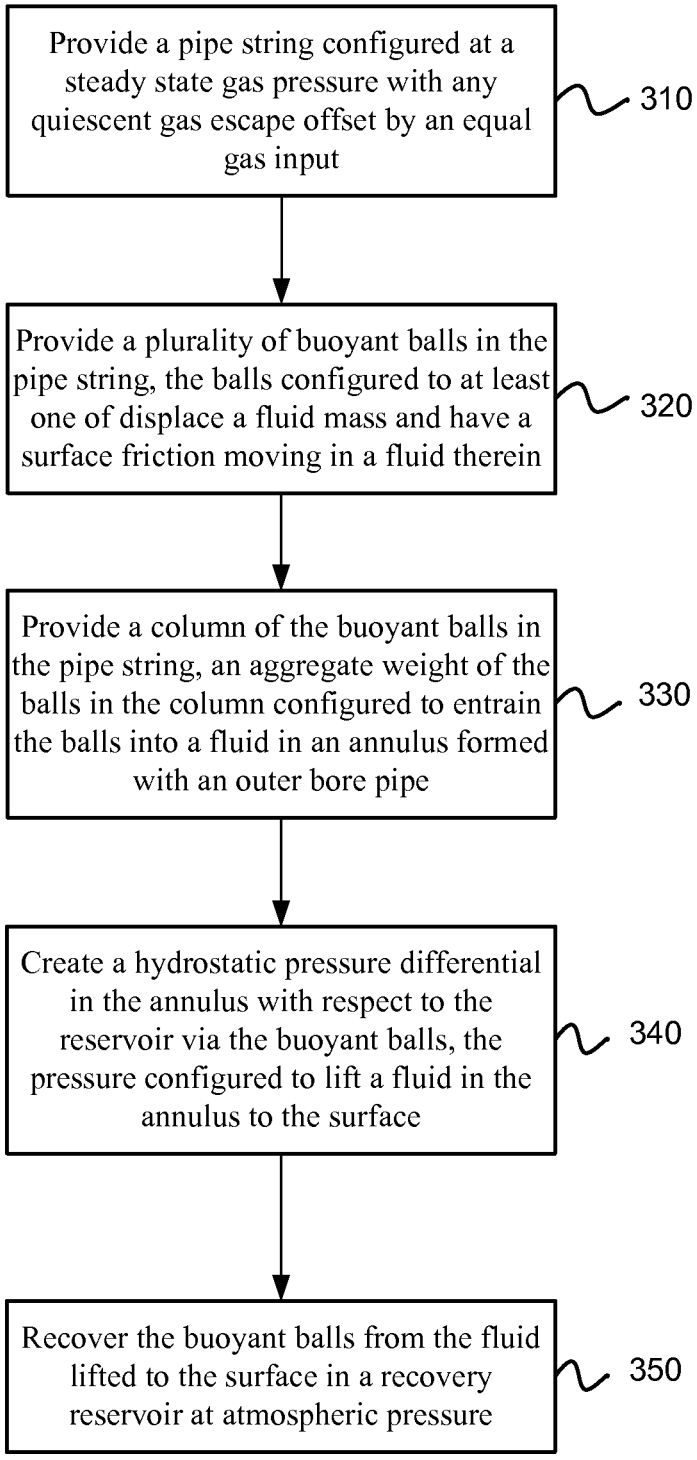
FIG. 2 is a block diagram of a method for buoyant ball assisted hydrostatic lift in accordance with an embodiment of the present disclosure.

FIG. 2 is a block diagram of a method for buoyant ball assisted hydrostatic lift in accordance with an embodiment of the present disclosure. The disclosed method includes providing 310 a pipe string configured at a steady state gas pressure with a quiescent gas escape offset by an equal gas input. The method also includes providing 320 a plurality of buoyant balls in the pipe string, the balls configured to at least one of displace a fluid mass and have a surface friction moving in a fluid therein. The method additionally includes providing 330 a column of the buoyant balls in the pipe string, an aggregate weight of the balls in the column configured to entrain the balls into a fluid in an annulus formed with an outer bore pipe. The method further includes creating 340 a hydrostatic pressure differential in the annulus with respect to the reservoir via the buoyant balls, the pressure configured to lift a fluid in the annulus to the surface. The disclosed method may yet include recovering 350 the buoyant balls from the fluid lifted to the surface in a recovery reservoir at atmospheric pressure.

An embodiment of the hydrostatic lift method includes forcing a water table in the pipe string submerged in the pipe string below the surface and proximal to a bottom end of the pipe string submerged in the reservoir via the steady state gas pressure. Also, the buoyant balls may provide an aggregate volume greater than a volume of the annulus. The buoyant balls may also form a column extending from a bottom end of the pipe string to a column height greater than a height of the fluid in the pipe string and the annulus. A height of the buoyant balls greater than a combined height of the pipe string and the annulus may be required for the balls to be entrained in the fluid(s) of the annulus. Also, a hydrostatic pressure differential created in the annulus with respect to the reservoir via the buoyant balls further comprises displacing a volume of fluids in the annulus and the pipe string from a bottom of the pipe string to an overflow of the annulus at the surface into a catch reservoir 145.

An embodiment of the hydrostatic lift method may further comprise providing a reservoir of the buoyant balls 140, the reservoir 140 disposed adjacent a top of the pipe string proximal the surface, the reservoir 140 configured to provide buoyant balls for the column of the buoyant balls in the pipe string at the steady state gas pressure. A catch reservoir 145 may be disposed adjacent a top of the annulus proximal the surface, the reservoir configured to provide a catch for the lifted fluid (s) and the buoyant balls. Recovering the buoyant balls from the fluid lifted to the surface in a recovery reservoir may comprise separating the buoyant balls from the fluid via a series of valves. Also, in order to reintroduce the buoyant balls into the column of buoyant balls in the pipe string, a ball reservoir may be disposed adjacent a top of the pipe string proximal the surface, the reservoir configured at the steady state gas pressure.

Figure 3:
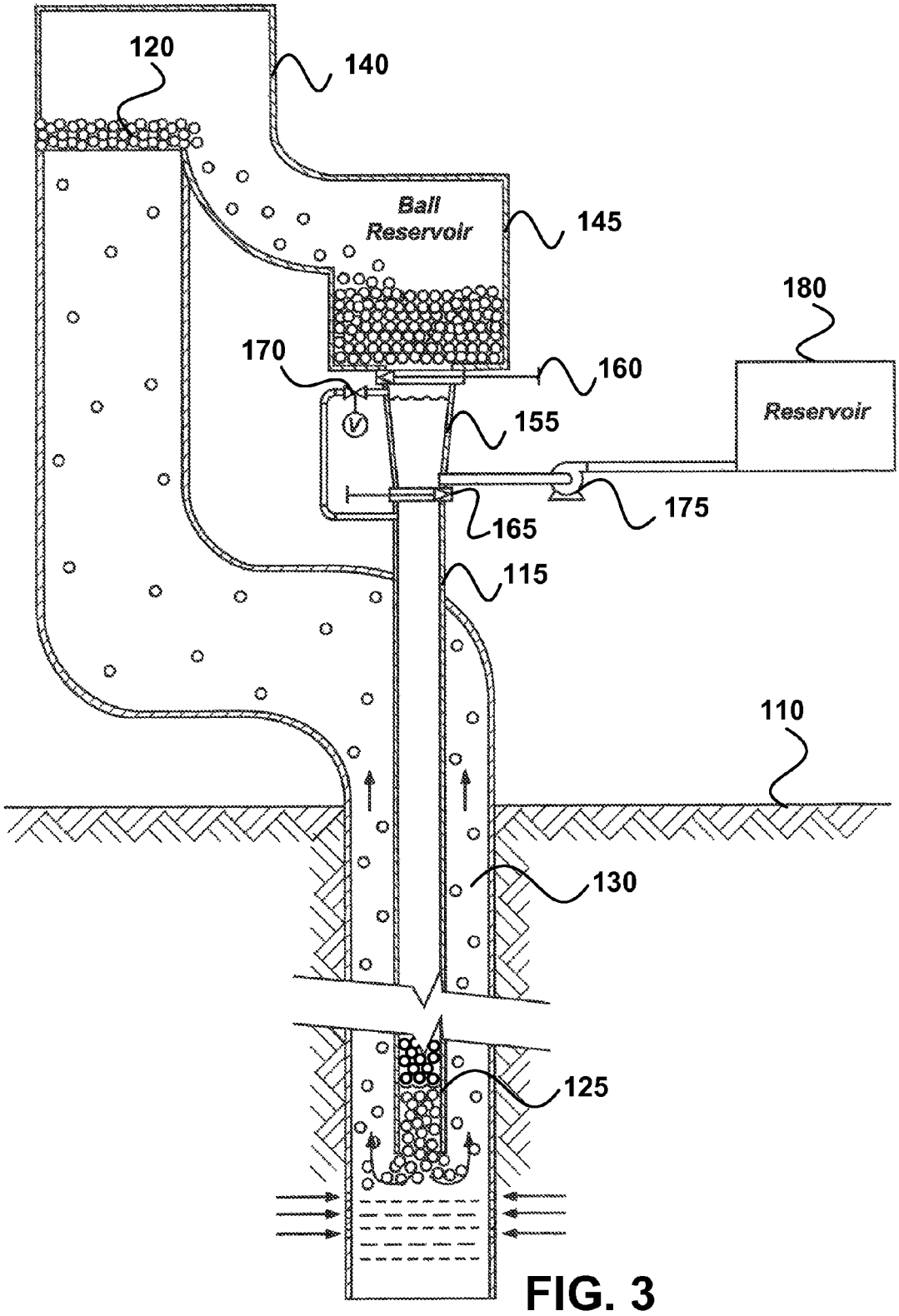
FIG. 3 is a cross sectional view of a buoyant ball recovery system in accordance with an embodiment of the present disclosure.

FIG. 3 is a cross sectional view of a buoyant ball recovery system in accordance with an embodiment of the present disclosure. The disclosed buoyant ball assisted hydrostatic lift system 100 lifts a fluid 105 and 150 from an enclosed subterranean reservoir to the earth's surface 110. The disclosed system 100 includes a pipe string 115 configured at a steady state gas pressure with any quiescent gas escape offset by an equal gas input. The system also includes a plurality of buoyant balls 120 in the pipe string 115, the balls configured to at least one of displace a fluid mass 105/150 and have a surface friction moving in the fluid(s) therein. The system 100 additionally includes a column 125 of the buoyant balls 120 in the pipe string 115, an aggregate weight of the balls 120 in the column 125 configured to entrain the balls 120 into a fluid 105/150 in an annulus 130 formed with an outer bore pipe 135. Embodiments of the present disclosure include various column heights where balls of greater density and weight allow shorter columns of balls in the pipe string able to entrain the balls in the fluid(s). The system further includes a hydrostatic pressure differential in the annulus 130 with respect to the reservoir via the buoyant balls 120, the pressure configured to lift the fluid 105 in the annulus 130 to the surface 110. A ball reservoir 140 and a recovery reservoir 145 are also depicted. Water 150 may be present in the reservoir and lifted into the recovery reservoir 145 via the disclosed system and method.

Further depicted in FIG. 3, a hopper 155 (aka hopper area) may be disposed between the ball reservoir 145 and the pipe string 115. A valve 160 may be disposed on the top of the hopper 155 that separates the ball reservoir 145 from the hopper area and a valve 165 on the bottom of the hopper 155 separates the hopper 155 from the high pressure zone there below in the pipe string. These valves 160 and 165 open and close to allow the balls to enter the hopper area 155 and the pipe string 115. After a pressure differential is mitigated, the balls 120 fall into the high pressure zone as gravity acts upon them. Valves 160 and 165 are depicted as slide valves, however, there are many other valves that may be used in embodiments of the present disclosure.

Again referring to FIG. 3, the lower valve 165 is closed, the vent valve 170 is closed and the upper hopper valve 160 is also closed. Prior to the upper slide valve 160 opening, a high pressure pump 175 pumps fluid from the reservoir 180 into the hopper chamber area 155. During the pumping sequence, the vent valve 170 is open to the high pressure zone. As the water table rises to the top of the hopper, the vent valve 170 to the high pressure zone is closed. The pump 175 is turned off and at that time the upper slide valve 160 opens. FIG. 3 highlights the hopper area full of fluid. The upper slide valve 160 is open to the ball reservoir above it. The vent valve to the high pressure zone is closed and the lower hopper slide valve 165 is closed.

Figure 4:
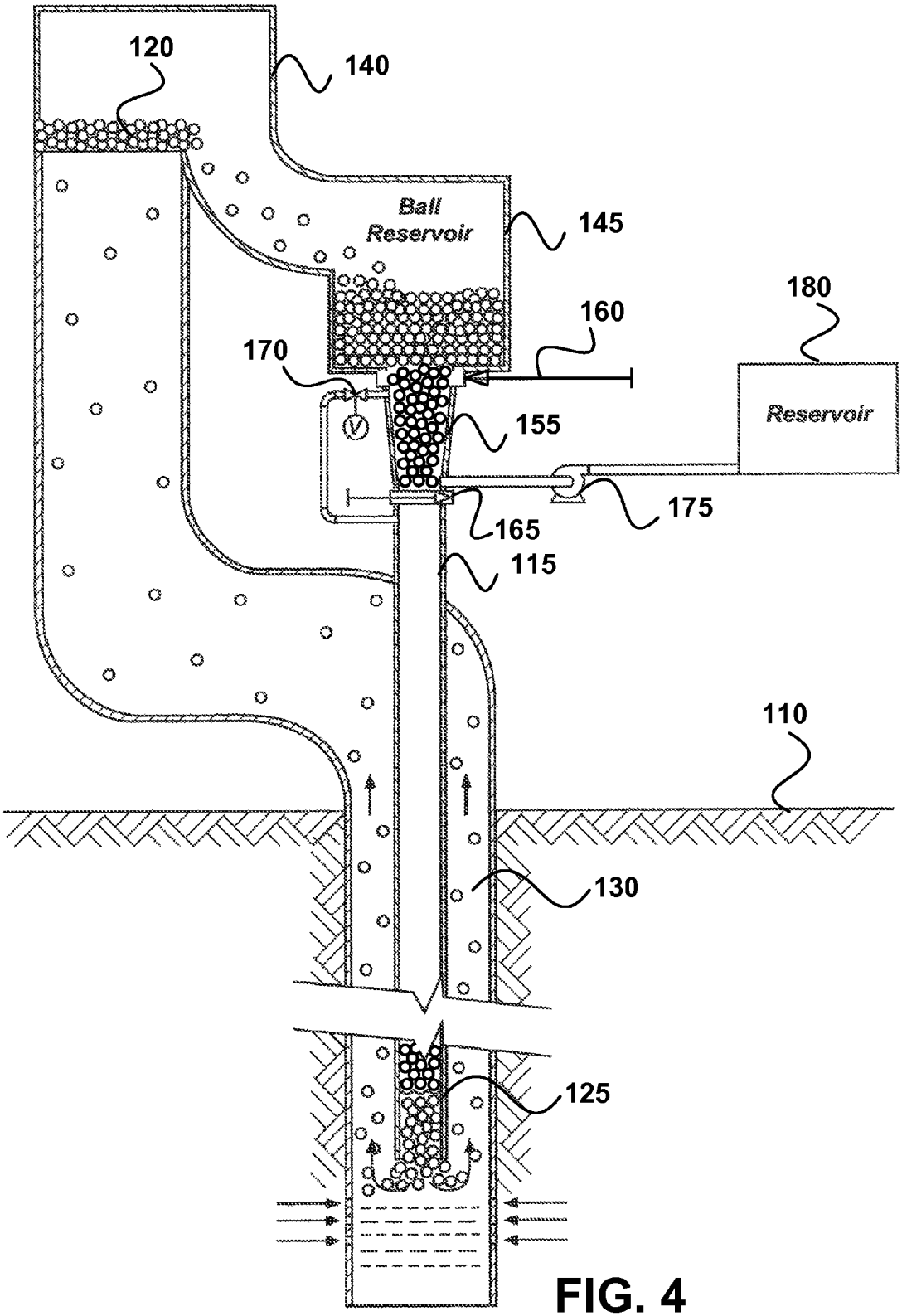
FIG. 4 is a cross sectional view of a buoyant ball recovery system where a ball hopper is vented in accordance with an embodiment of the present disclosure.

FIG. 4 is a cross sectional view of a buoyant ball recovery system where a ball hopper is vented in accordance with an embodiment of the present disclosure. Elements depicted are similar or the same as the elements depicted in FIG. 3. The lower slide valve 165 is closed. The upper slide valve 160 is open and the vent valve 170 is closed. The ball reservoir 145 is full of buoyant balls 120 that are now floating on top of the fluid level. At this point, the pump 175 is turned on and the fluid is pumped out of the hopper area 155 into the reservoir 180. As the fluid is pumped out, the buoyant balls 120 float on the fluid and descend into the hopper area 155.

Figure 5:
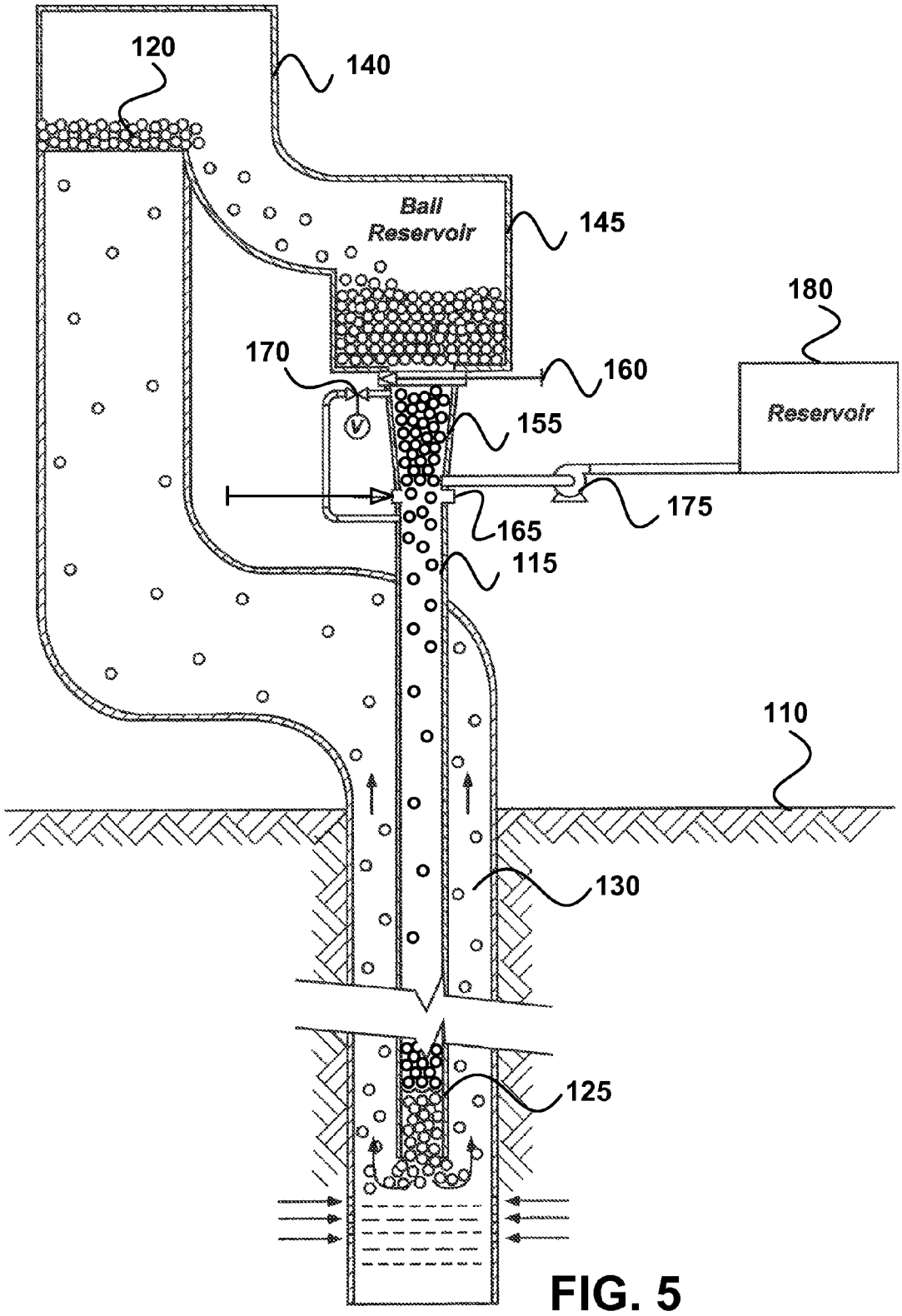
FIG. 5 is a cross sectional view of a buoyant ball recovery system where the balls enter the pipe string in accordance with an embodiment of the present disclosure.

FIG. 5 is a cross sectional view of a buoyant ball recovery system where the balls enter the pipe string in accordance with an embodiment of the present disclosure. Elements depicted are similar or the same as the elements depicted in FIG. 3. The upper valve 160 is closed separating the ball reservoir 145 from the hopper area 155. The pump 175 has been turned off and the vent valve 170 to the high pressure zone is open. The vent valve 170 vents to the high pressure zone while opened and allows the pressure to come to equilibrium in the hopper area 155 with the high pressure zone. At the end of this event, the lower slide valve 165 opens allowing the balls 120 to descend into the high pressure zone as gravity acts upon them. When the hopper 155 is emptied of its balls 120, the lower slide valve 165 closes again.

Figure 6:
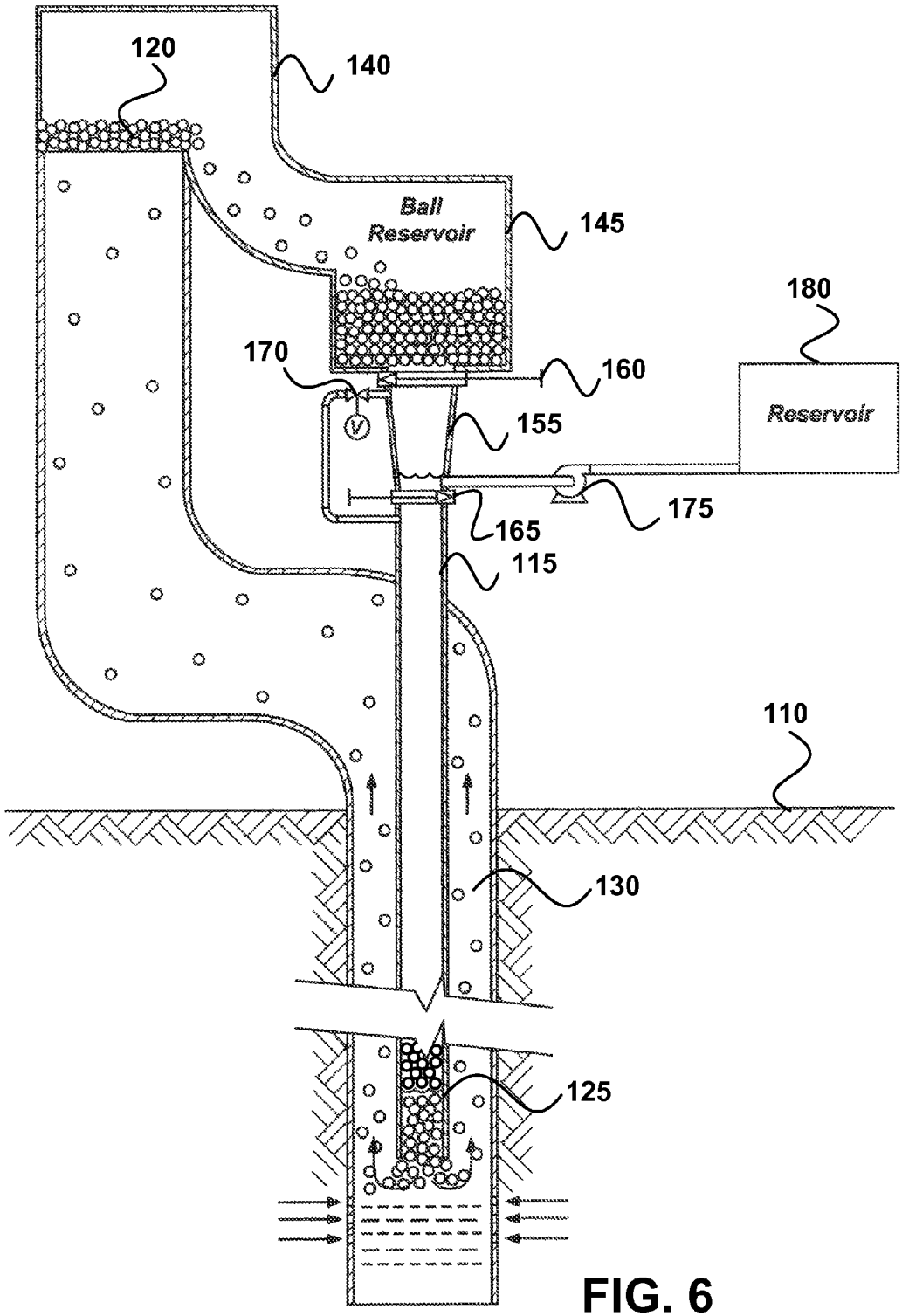
FIG. 6 is a cross sectional view of a buoyant ball recovery system where the hopper is filled with liquid in accordance with an embodiment of the present disclosure.

FIG. 6 is a cross sectional view of a buoyant ball recovery system where the hopper is filled with liquid in accordance with an embodiment of the present disclosure. Elements depicted are similar or the same as the elements depicted in FIG. 3. The lower slide valve 165 is closed. The upper slide valve 160 is closed and the vent valve 170 leading to the high pressure zone is left open. The pump 175 is turned on. The pump 175 is sufficiently powerful to overcome the pressure differential and proceeds to fill the hopper area 155 again with fluid from the reservoir 180. Upon topping off the hopper area 155, the pump 175 turns off, the vent valve 170 to the high pressure zone is closed and the process repeats itself starting back at FIG. 3.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A hydrostatic lift system for lifting fluid(s) from an enclosed subterranean reservoir to the earth's surface, the system comprising:

a) a pipe string configured with a quiescent gas therein under a steady state gas pressure with any quiescent gas escape offset by an equal gas input;

b) a plurality of buoyant balls gravity fed down the pipe string, the balls configured to at least one of displace a fluid mass and have a surface friction moving in a fluid therein;

c) a column of the buoyant balls in the pipe string, an aggregate weight of the balls in the column configured to entrain the balls into a fluid in an annulus formed with an outer bore pipe; and d) a hydrostatic pressure differential in the annulus with respect to the reservoir via the entrained buoyant balls, the pressure configured to lift the entraining fluid and the entrained balls in the annulus to the surface.

2. The hydrostatic lift system of claim 1, wherein the quiescent gas under the steady state gas pressure and the column of buoyant balls are vice versa disposed in the annulus and an entrainment comprising the entraining fluid and the entrained buoyant balls is vice versa disposed in the pipe string to enable a hydrostatic pressure differential in the pipe string to lift the entrainment to the earth's surface.

3. The hydrostatic lift system of claim 1, wherein the quiescent gas in the pipe string under the steady state gas pressure forces a water table in the pipe string submerged in the reservoir below the surface and proximal to a bottom end of the pipe string submerged in the reservoir.

4. The hydrostatic lift system of claim 1, wherein the buoyant balls comprise a specific gravity less than a ratio of one in relation to the specific gravity of the fluid in the annulus.

5. The hydrostatic lift system of claim 1, wherein the column of buoyant balls forms under an aggregate weight of the buoyant balls and extends from a bottom end of the pipe string to a column height greater than a height of the fluid in the string pipe and the annulus.

6. The hydrostatic lift system of claim 1, wherein the hydrostatic pressure is a product of gravity acting on a fluid density of any fluids in the pipe string and the annulus displaced by the aggregate volume of the buoyant balls therein and the height of the fluids from a confluence of the balls in the fluids to an overflow of the annulus at the surface into a catch reservoir.

7. The hydrostatic lift system of claim 1, wherein the balls may comprise spherical, semi-spherical, semi-circular and other geometrical bead-like configurations of various sizes and specific gravities.

8. The hydrostatic lift system of claim 1, wherein the surface friction of the buoyant balls moving through the fluid creates a loss of hydrostatic pressure in the annulus and creates a lift of the fluid at a greater hydrostatic pressure in the subterranean reservoir to the surface through the annulus.

9. The hydrostatic lift system of claim 1, further comprising a reservoir of the buoyant balls, the reservoir disposed adjacent a top of the pipe string proximal the surface, the reservoir configured to provide buoyant balls for the column of the buoyant balls in the pipe string at the steady state gas pressure.

10. The hydrostatic lift system of claim 1, further comprising a catch reservoir disposed adjacent a top of the annulus proximal the surface, the reservoir configured to provide a catch for the lifted fluid(s) and the buoyant balls.

11. The hydrostatic lift system of claim 1, further comprising a recovery hopper and a series of valves configured to separate the buoyant balls from the fluid rising to the surface in a catch reservoir at atmospheric pressure.

12. A hydrostatic lift method for lifting fluid(s) from an enclosed subterranean reservoir to the earth's surface, the method comprising:

a) providing a pipe string configured with a quiescent gas therein under a steady state gas pressure with any quiescent gas escape offset by an equal gas input;

b) providing a plurality of buoyant balls gravity fed down the pipe string, the balls configured to at least one of displace a fluid mass and have a surface friction moving in a fluid therein;

c) providing a column of the buoyant balls in the pipe string, an aggregate weight of the balls in the column configured to entrain the balls into a fluid in an annulus formed with an outer bore pipe; and d) creating a hydrostatic pressure differential in the annulus with respect to the reservoir via the buoyant balls, the pressure configured to lift a fluid in the annulus to the surface.

13. The hydrostatic lift method of claim 12, wherein providing a pipe string configured with a quiescent gas under a steady state gas pressure includes forcing a water table in the pipe string submerged in the reservoir below the surface and proximal to a bottom end of the pipe string submerged in the reservoir.

14. The hydrostatic lift method of claim 12, wherein providing a plurality of the buoyant balls comprises providing an aggregate volume of buoyant balls greater than a volume of annulus.

15. The hydrostatic lift method of claim 12, wherein providing a column of buoyant balls comprises forming a column extending from a bottom end of the pipe string to a column height greater than a height of the fluid in the pipe string and the annulus.

16. The hydrostatic lift method of claim 12, wherein creating a hydrostatic pressure differential in the annulus with respect to the reservoir via the buoyant balls further comprises displacing a volume of fluid(s) in the annulus and the pipe string from a bottom of the pipe string to an overflow of the annulus at the surface into a catch reservoir.

17. The hydrostatic lift method of claim 12, further comprising providing a supply reservoir and a catch reservoir of buoyant balls, the supply reservoir disposed adjacent a top of the pipe string proximal the surface and the catch reservoir disposed adjacent a top of the annulus also proximal the surface, the supply reservoir configured to provide buoyant balls for the column of buoyant balls in the pipe string and the catch reservoir configured to provide a catch for the lifted fluid(s) and the buoyant balls.

18. A hydrostatic lift method for lifting a fluid from an enclosed subterranean reservoir to the earth's surface, the method comprising:

a) providing a pipe string configured with a quiescent gas therein under a steady state gas pressure with a quiescent gas escape offset by an equal gas input;

b) providing a plurality of buoyant balls gravity fed down the pipe string, the balls configured to at least one of displace a fluid mass and have a surface friction moving in a fluid therein;

c) providing a column of the buoyant balls in the pipe string, an aggregate weight of the balls in the column configured to entrain the balls into a fluid in an annulus formed with an outer bore pipe;

d) creating a hydrostatic pressure differential in the annulus with respect to the reservoir via the buoyant balls, the pressure configured to lift a fluid in the annulus to the surface; and e) recovering the buoyant balls from the fluid lifted to the surface in a recovery reservoir at atmospheric pressure.

19. The hydrostatic lift method of claim 18, wherein recovering the buoyant balls from the fluid lifted to the surface in a recovery reservoir comprises separating the buoyant balls from the fluid via a series of valves.

20. The hydrostatic lift method of claim 19, further comprising reintroducing the buoyant balls into a ball reservoir disposed adjacent a top of the pipe string proximal the surface, the reservoir configured at the steady state gas pressure to provide buoyant balls for the column of the buoyant balls in the pipe string.

* * * * *